US005797198A

United States Patent [19]

Pomerantz

[11] Patent Number: 5,797,198

[45] Date of Patent: Aug. 25, 1998

[54] ADJUSTABLE SHOCK ABSORBING DEVICE FOR SHOE

[76] Inventor: David B. Pomerantz, 251 174th St., Apt. 504, Miami Beach, Fla. 33160

[21] Appl. No.: 666,866

[22] Filed: Jun. 19, 1996

[51] Int. Cl.[6] ..... A43B 21/30; A43B 13/18

[52] U.S. Cl. ..... 36/27; 36/37

[58] Field of Search ..... 36/27, 38, 37, 36/28, 7.8

[56] References Cited

U.S. PATENT DOCUMENTS

| | | | |
|---|---|---|---|
| 4,566,206 | 1/1986 | Weber | 36/38 X |
| 4,894,934 | 1/1990 | Illustrato | 36/37 |
| 5,282,325 | 2/1994 | Beyl | 36/27 |
| 5,367,790 | 11/1994 | Gamow et al. | 36/27 |
| 5,396,718 | 3/1995 | Schuler et al. | 36/27 X |
| 5,437,110 | 8/1995 | Goldston et al. | 36/27 X |

FOREIGN PATENT DOCUMENTS

| | | | |
|---|---|---|---|
| 2507066 | 12/1982 | France | 36/27 |
| 2200030 | 7/1988 | United Kingdom | 36/27 |

*Primary Examiner*—Ted Kavanaugh
*Attorney, Agent, or Firm*—Bucknam and Archer

[57] ABSTRACT

There is provided an adjustable shock absorbing device for a shoe having a horizontal stiff bracket fixed to the midsole of the shoe, a heel plate pivotally mounted at a forward end to the bracket and disposed in the heel portion of the shoe below the wearer's heel, a spring biasing the rearward end of the heel plate vertically relative to the bracket, and an adjustment device for varying the tension of the biasing spring to accommodate changes desired by the wearer.

14 Claims, 9 Drawing Sheets

ADJUSTABLE SHOCK ABSORBING DEVICE FOR SHOE

FIELD OF THE INVENTION

The present invention relates to a shock absorbing device for a shoe, and in particular such a device for an athletic shoe. More specifically, the invention relates to an adjustable device to be utilized in the construction of athletic shoes in order to absorb shock when the wearer's heel strikes the ground. Furthermore, the present invention attempts to improve efficiency through the restoration of captured energy to the foot. Additionally, the invention provides for cradling of the wearer's heel during walking or running.

PRIOR ART

The introduction of a mechanism into the construction of athletic shoes that can absorb some of the shock energy associated with having one's heel striking the ground can help mitigate bodily damage resulting from walking or running. Specifically, injury to knees, joints and feet are among several potential ailments that can develop as a result of having a poor shock absorption system in a person's shoes.

Many devices have been developed in order to address the need for an effective shock absorption system. Foam oriented shock devices are not very durable as they tend to compress or flatten out, also they are only somewhat effective in returning shock energy back to the foot. Those inventions utilizing springs are not easily manufactured and are often very clumsy, as the various springs in such a mechanism tend to shift and/or depress at different rates below the foot. Such variable depression can lead to foot instability which is a major contributor to foot related injury. Although air, gas and fluid filled pockets are solutions which are somewhat effective, they are undesirable since they have an effect as though one is "walking on a tennis ball". Also, such air pockets do not cover a large enough area, creating an unbalanced, non-uniform feel on the foot that can be quite annoying.

Shock absorption systems employing resilient plates have merit. They are able to absorb and redistribute shock energy to the foot thus providing for increased efficiency. Furthermore, most resilient plate based devices employ means to cradle the heel upon impact. However, there are several drawbacks associated with such devices. Resilient plates attached on only one side tend to have a wobble effect when more weight is placed on one side than another. This can contribute to instability of the heel and possibly result in injury. Those systems employing a narrow resilient plate in order to minimize this wobble effect are disadvantageous since they do not provide sufficient heel coverage in order to be worthwhile. Also, such a design does not allow for optimal heel cradling since the depressed area created by narrow resilient plates is not large enough to accept the wide heel.

Other types of resilient plates suffer from requiring the heel to have its initial impact in the relatively high-elastic center of the plate in order to be optimally effective. An initial impact in an area other than the center, which occurs frequently during exercise and other sporting activity, can be troublesome since these areas tend to be less elastic. Such non-center impact can result in injury by having the heel initially striking the relatively inelastic perimeter of the plate thereby causing little shock absorption. Also, non-center initial impact tricks the wearer into tensing his joints, ligaments, as well as his overall muscular-skeletal makeup in order to protect itself from the shock associated with the shoe's heel striking the ground. Such deception leads the wearer to flex thinking that his or her heel has firmly landed, and is not subject to further depression. However, in reality, such flexing is premature and misguided since unbeknownst to the wearer a portion of their heel will descend significantly into the depths created by the highly elastic center. This could cause the heel to turn in an awkward and unpredictable manner leaving the user in a very vulnerable position. Also, the restoration of energy through resilient plates of this nature are often directed upward, rather than in the more efficient direction of upward and forward.

U.S. Pat. No. 4,912,859, to Ritts, describes a shoe device that is primarily a jumping device. At Column 1, lines 9–10, the patentee states that a person can "exercise or have fun by using the spring shoe to jump". Although the device introduces a novel method of improving stability of the spring shoe by limiting undesired lateral and longitudinal movement, there would be problems associated with this device if employed as a shock absorbing device in an athletic shoe. As the Ritts patent discloses, the device is free to tilt in pitch, i.e., the front tilts up or down. Such tilting is undesirable in an athletic shoe since rear tilting makes more sense, especially for heel strikers. Furthermore, with front tilting the restoration of captured energy is not returned to the foot in an efficient manner. In addition to this, as the Ritts patent indicates, when the shoe hits the ground the top plate moves downward and slightly forward. Such forward movement is undesirable since the construction of the shoe would have to allow for excess room in front of the shoe in order to accommodate such forward movement of the top plate. This excess room does not allow for the foot to be secure in the shoe, rather the foot tends to shift forward and backward when walking or running.

A shock absorption device for a shoe that is capable of storing shock energy so that it can be returned to the foot, when the heel is lifted, maximizes efficiency. Furthermore, a device that cradles the heel during running is desirable in the sense that it promotes foot stability hence reducing the risk of injury. Other desirable attributes for such a shock absorbing device for a shoe include the capability to adjust the tension of the device as well as the angle of the heel plane.

No prior art device has been able to effectively satisfy all of the above mentioned criteria. The present invention provides for the most advanced solution to all of the requirements for an effective shock absorption system.

SUMMARY OF THE INVENTION

A primary object of the present invention is to provide a sturdy shock absorption device for a shoe that provides for a heel plate that pivots at a constant angle throughout. This significantly reduces "wobble effect" and non-center initial impact problems associated with certain types of resilient based shock absorption systems for shoes.

Another object of the present invention is to provide a means to adjust the tension of the heel plate of the shoe so that the shoe can be adapted to different types of activities, ground surfaces, as well as to the different weights of potentional users.

It is also an object of the invention to incorporate a means for adjusting the angle of the heel plate in its stable state (when no downward force is placed on it) in order to accommodate individual preference, as well as to satisfy the needs of both "full-foot striker" and "heel striker" individuals.

A further object is to have the device cradle the wearer's heel upon impact with the ground, thus improving stability and minimizing the risk of injury.

Also, it is an object of the present invention to store shock energy created during heel strike and to return this energy to the heel in an upward and forward direction.

Another object of the present invention permits the individual user or wearer to adjust the shock absorbing device of the shoe, which can be done easily from the exterior of the shoe, thereby creating a more diverse and entertaining shoe to wear.

The adjustable shock absorbing device of the present invention utilizes one metal bracket and one thin, firm, heel shaped inflexible and non-resilient metal plate. The bracket is intended to be stationary and permanently affixed to the midsole of the shoe, while the heel plate is adapted to pivot on a horizontal rod. The non-moveable bracket is closer to the front of the shoe, while the heel plate is towards the back of the shoe. The bracket lies horizontally, while the heel plate, when no weight is placed on it, lies either horizontally or on a slight positive incline towards the back of the shoe. Such an incline may be desirable for satisfying individual preference, as well as to address the need of both full-foot strikers and heel strikers. The heel plate is capable of having its steady state angle adjusted as will be more fully described hereinafter.

A horizontal rod is fed through holes located on vertical flaps arranged on two lateral corners of both the heel plate and the bracket. This rod connects the heel plate and the bracket, as the vertical flaps of both the heel plate and the bracket are overlapping. This rod should be wide on its two ends in order to prevent the flaps from slipping off of the rod. The heel plate is located below the wearer's heel bone (calcaneus). Beneath this heel plate is a recess which allows the heel plate to pivot downard in response to force placed upon it. The heel plate pivots about the horizontal rod and is therefore only capable of pivoting on a constant angle all along the plate. A helical spring surrounds the horizontal rod. The spring has two tails or ends which come over the top of the rod—one pointing towards the front of the shoe, and the other pointing towards the back of the shoe. The tail end facing the back of the shoe is long and straight and is fed underneath the heel plate. The tail end of the spring facing the front of the shoe is attached either to the horizontal rod, to a disk arranged on the rod (between the four flaps) that is capable of turning independently, attached to a disk affixed to the horizontal rod (also between the four flaps), or just suspended on its own. In each of these situations, it is essential that the tail end facing the front of the shoe is restricted so that it does not rise beyond a certain level since this provides the flexible plate with upward force that is derived, in part, from the tension placed on the spring tail facing the front of the shoe. By manipulating the front facing spring tail so that it is forced further downward provides an overall increase in the tension of the spring and hence requires more force on the heel plate in order to cause it to pivot downward. This adjustable tension feature may be desirable in order to reflect the fact that individuals will partake in various activities each with different requirements, and that individuals are likely to run on different surfaces having differing impact consequences. Another important issue relating to adjustable tension is the ability of the device to accommodate people of different weights.

As a person walks, or runs, their heel strikes the heel plate which is normally (when no weight is placed on it) forced by the spring to remain in the most upward inclined position permitted by the device of the present invention. The heel strike itself overcomes the spring force leading to a downward pivot of the heel plate about the horizontal rod. The heel plate is permitted to descend into the recess therebelow. The heel plate does not cover the full area of the back portion of the shoe, so as to leave room around the perimeter in order to accommodate a rear collar that is U-shaped and situated around the rounded back portion of the shoe. This collar resides below the level of the heel plate in its stable state, that is, when no downward force is placed on it. The collar helps to push up the outer edges of the insole once the heel strike forces the heel plate downward. In this way, the outer edges of the insole act to cradle the heel upon impact. As the person lifts their foot a portion of the shock energy captured during heel strike is returned to the foot as the heel lifts. At that time the plate will pivot upward and be repositioned to absorb the shock associated with the next step.

BRIEF DESCRIPTION OF THE DRAWINGS

Other objects and features of the present invention will become apparent from the following detailed description considered in connection with the accompanying drawings, in which.

DETAILED DESCRIPTION

Figure 1:
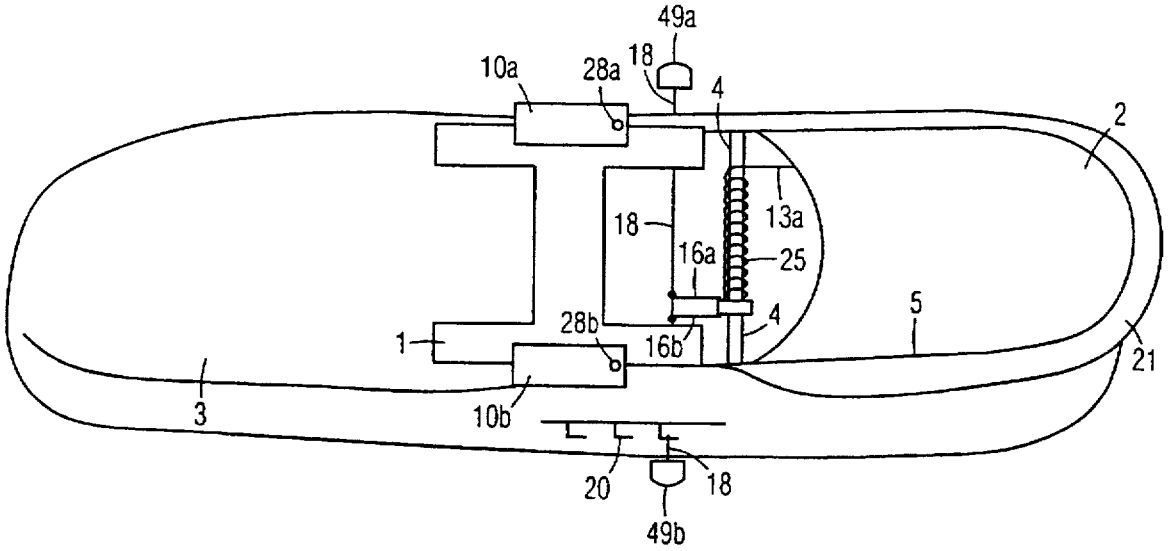
FIG. 1 is a top plan view of the midsole of a shoe incorporating the device of the present invention.
Figure 2:
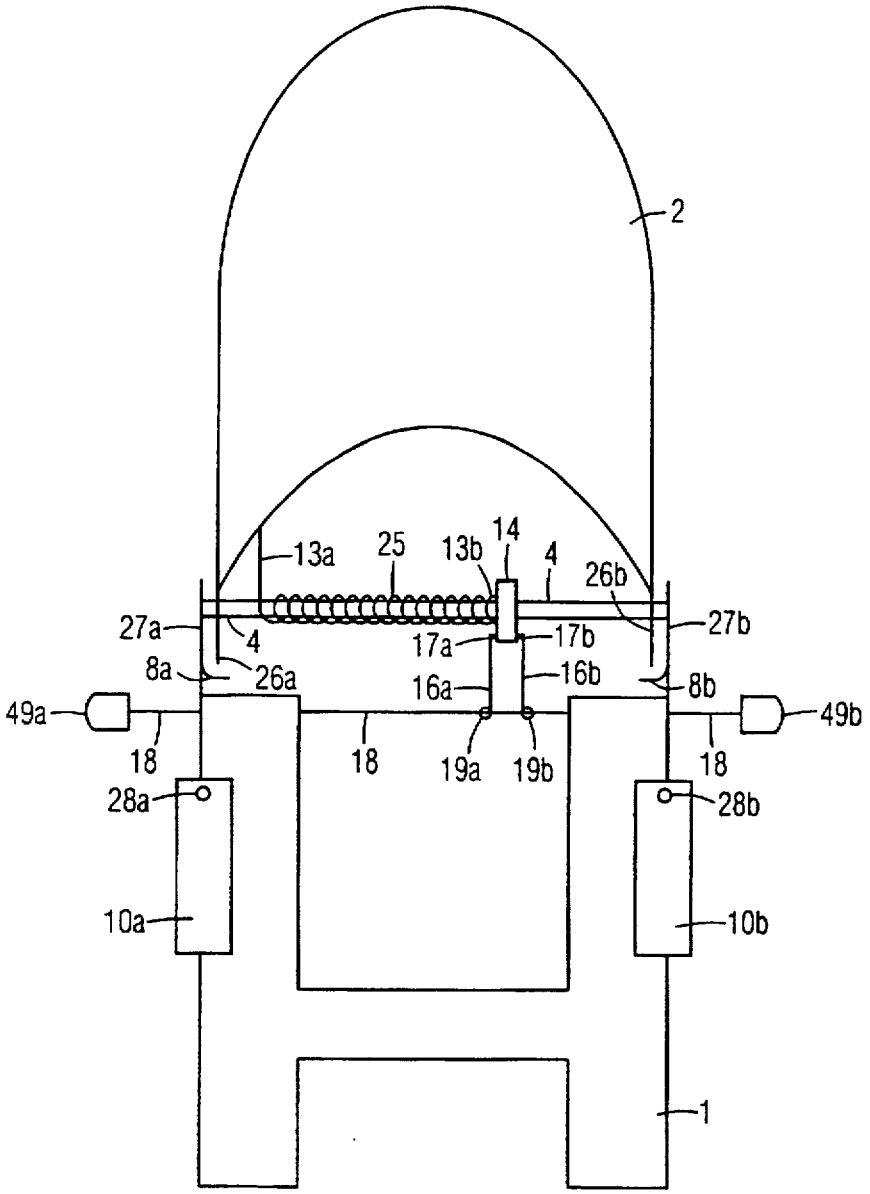
FIG. 2 is an enlarged top plan view of the device of the present invention shown in FIG. 1.
Figure 3:
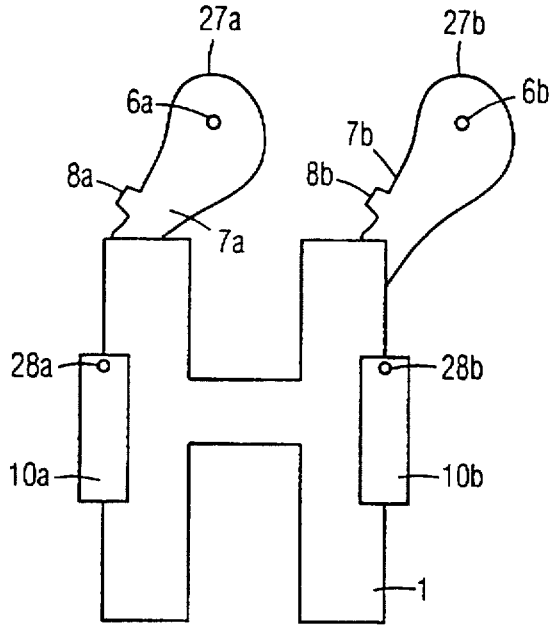
FIG. 3 is a top perspective view of the bracket of the present invention.
Figure 4:
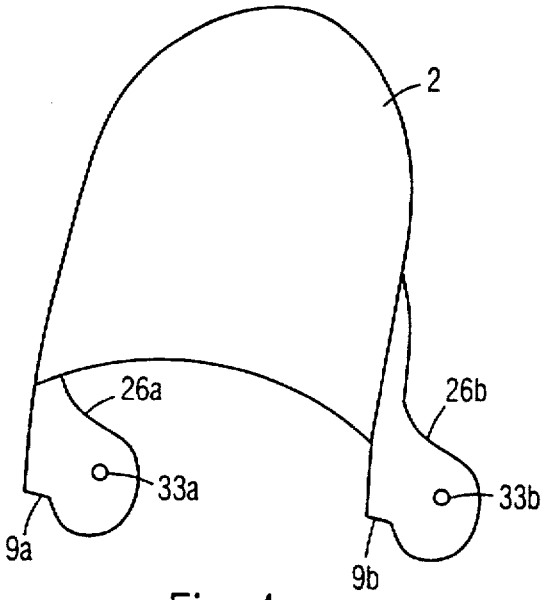
FIG. 4 is the top perspective view of the heel plate of the present invention.

Referring to FIGS. 1 and 2, therein is shown a metal bracket (1) and a thin, firm, inflexible and non-resilient heel shaped metal plate (2). The bracket (1) is intended to be stationary and permanently affixed to the midsole (3) of the shoe, while the heel plate (2) is adapted to pivot on a horizontal rod (4). The bracket (1) has a pair of downward vertical flaps (27*a*) and (27*b*) and the heel plate (2) also has a pair of downward vertical flaps (26*a*) and (26*b*). All four flaps are perpendicular to the bracket (1) and to the heel plate (2). These flaps, as illustrated in FIG. 3 and FIG. 4, have holes (6*a*) and (6*b*) in the bracket flaps (27*a*) and (27*b*) and holes (33*a*) and (33*b*) in the heel plate flaps (26*a*) and (26*b*). The horizontal rod (4) is fed through these vertical holes (6*a*), (6*b*), (33*a*) and (33*b*) so as to form mounting means mounting the heel plate (2) to bracket (1). Rod (4) connects the heel plate (2) to the bracket (1) as the vertical flaps of both the heel plate (26*a*) and (26*b*) and the bracket (27*a*) and (27*b*) are overlapping. The rod (4) should be wide on its two ends on the outer portion of the bracket's flaps (27*a*) and (27*b*) in order to prevent the flaps (27*a*) and (27*b*) from slipping off of the rod (4). The bracket flaps (27*a*) and (27*b*) are located closer to the outer lateral sides of the shoes. This enables the heel plate (2) to be securely attached to the bracket (1). There should be ample room so that the thickness of the rod (4) does not cause excessive friction with the holes (6*a*), (6*b*), (33*a*) and (33*b*) thereby preventing a smooth pivot of the heel plate (2). However, no excess space should be present lest the heel plate (2) wobble when rotating on the rod (4). A washer (not shown) may be utilized in between the flaps of the bracket (27*a*) and (27*b*) and the flaps of the heel plate (26*a*) and (26*b*) in order to minimize friction between these flaps.

The heel plate (2) is located below the wearer's heel bone or calcaneus. Beneath this heel plate (2) is a recess (5), see FIG. 1, which will allow the heel plate (2) to pivot downward in response to force placed upon it. The heel plate (2) pivots on the horizontal rod (4) and is therefore adapted to pivot only on a constant angle all along the plate (2) without side ways movement or wobble. The bracket (1) is closer to the front of the shoe, while the heel plate (2) is towards the back of the shoe. The bracket (1) lies horizontally, while the heel plate (2), when no weight is placed on it, is adapted to lie either horizontally or on a slight positive incline towards the back of the shoe. Such an incline may be desirable for satisfying individual preference, as well as to address the need of both full-foot striker and heel striker individuals.

Figure 5:
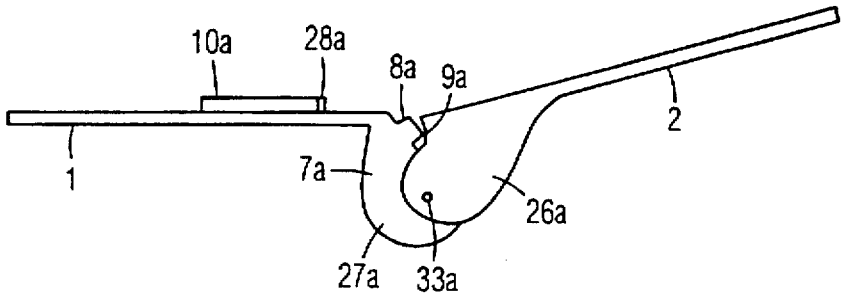
FIG. 5 is a cross-sectional view of the device of the present invention taken along line 5—5 of FIG. 2.
Figure 6:
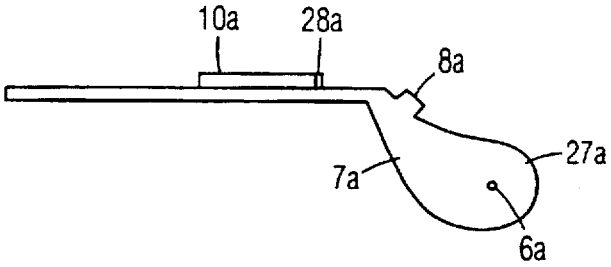
FIG. 6 is a view of the bracket shown in FIG. 5.
Figure 7:
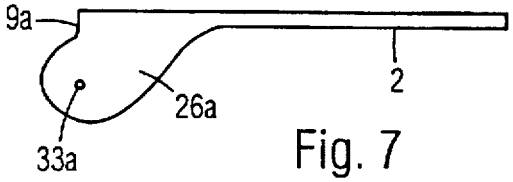
FIG. 7 is a view of the heel plate shown in FIG. 5.

In a preferred embodiment, the bracket flaps (27*a*) and (27*b*) of FIG. 3 are located on the outer lateral portion of the shoe while the heel plate flaps (26*a*) and (26*b*) of FIG. 4 are located on the inside of flaps (27*a*) and (27*b*). FIG. 5 illustrates bracket (1)—heel plate (2) interaction and their corresponding flaps (27*a*) and (26*a*). FIG. 6 shows one of the bracket flaps (27*a*) wherein the back inner (towards the middle of the shoe) neck portion (7*a*) and (7*b*) of both of the bracket flaps (27*a*) and (27*b*) include a rectangular "stop" appendage (8*a*) and (8*b*) that is attached on its long side perpendicular to each of the bracket flaps (27*a*) and (27*b*). This "stop" device (8*a*) and (8*b*) extends upwards from the bracket's neck (7*a*) and (7*b*) and it should be angled upwards and is intended to stop the heel plate's (2) motion by colliding with a vertical cutout portion or stop (9*a*) and (9*b*) on each of the heel plate flaps (26*a*) and (26*b*). FIG. 7 shows one side of the heel plate flaps (26*a*) with its corresponding cutout portion (9*a*). It is essential for the "stop" mechanism (8*a*) and (8*b*) to not be located on the rounded portion of the bracket flaps (27*a*) and (27*b*) since the bracket flaps (27*a*) and (27*b*) are situated on the outer portion and would therefore interfere with the heel plate flaps (26*a*) and (26*b*) if the "stop" device (8*a*) and (8*b*) were placed on the rounded area of flaps (27*a*) and (27*b*). Therefore, the "stop" mechanism (8*a*) and (8*b*) is situated on the inner back neck portion (7*a*) and (7*b*) of the bracket flaps (27*a*) and (27*b*). By angling the "stop" device (8*a*) and (8*b*) on an upward angle, the vertical cutout (9*a*) and (9*b*) of the heel plate flaps (26*a*) and (26*b*) will halt the heel plate's (2) motion on an upward angle.

Figure 8:
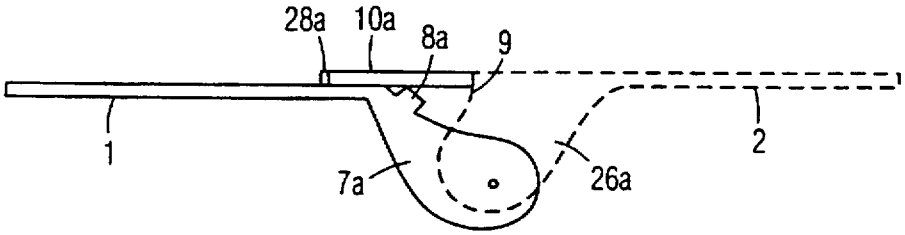
FIG. 8 is a view similar to FIG. 5 showing the adjustment feature for the heel plate.

In order to make the heel plate (2) have its dormant state (when no weight is placed on it) on a horizontal level, a pair of latches (10*a*) and (10*b*) should be attached to the top portion of the bracket (1) by means of small pivots that are essentially small pins (28*a*) and (28*b*). FIG. 8 shows one of the bracket's latches (10*a*) and its corresponding pin (28*a*). The latch (10*a*) as seen in FIG. 8 has been pivoted rearwardly and is facing towards the back of the shoe. When the heel plate (2) is desired to be inclined upward (positive slope towards the back of the shoe) when dormant, the latches (10*a*) and (10*b*) are pivoted towards the front of the shoe so that they cannot come into contact with the heel plate flaps (26*a*) and (26*b*) cutout portion or stops (9*a*) and (9*b*). However, when one wishes to have the heel plate (2) horizontal (under dormant conditions), the latches (10*a*) and (10*b*) are pivoted towards the back of the shoe so that it prevents the heel plate (2) from rising once the plate (2) achieves a horizontal position as shown in FIG. 8. In this way, the gap between the heel plate's cutout portion (9*a*) and (9*b*) and the "stop" device (8*a*) and (8*b*) provides an earlier obstacle to the heel plate flaps (26*a*) and (26*b*) cutout portion (9*a*) and (9*b*). This adjustment prevents the heel plate (2) from achieving any level above the horizontal state (or any other level sought by the designers). It is critical for the heel plate flaps (26*a*) and (26*b*) cutout portion (9*a*) and (9*b*) to be high enough so that these cutouts (9*a*) and (9*b*) will be able to be affected by latches' (10*a*) and (10*b*) presence when the latches (10*a*) and (10*b*) are pointed towards the rear of the shoe. These latches (10*a*) and (10*b*) can be accessible through the outside portion of the shoe. Adjustments can be made by using the thumb and pointer finger to grasp latch (10*a*) and (10*b*) and alter their position via the pivot (28*a*) and (28*b*). Latches (10*a*) and (10*b*) reside in a concave area (not shown) so that the person's fingers will be able to make the desired changes without the need for the latches (10*a*) and (10*b*) to protrude awkwardly from the base of the shoe.

Figure 9:
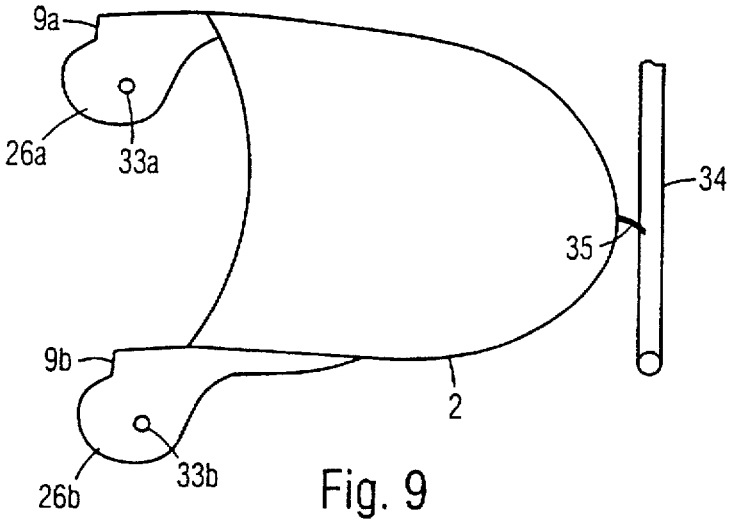
FIG. 9 is an embodiment utilizing a string attached to the underside of the heel plate in order to adjust the angle of the heel plate.
Figure 10:
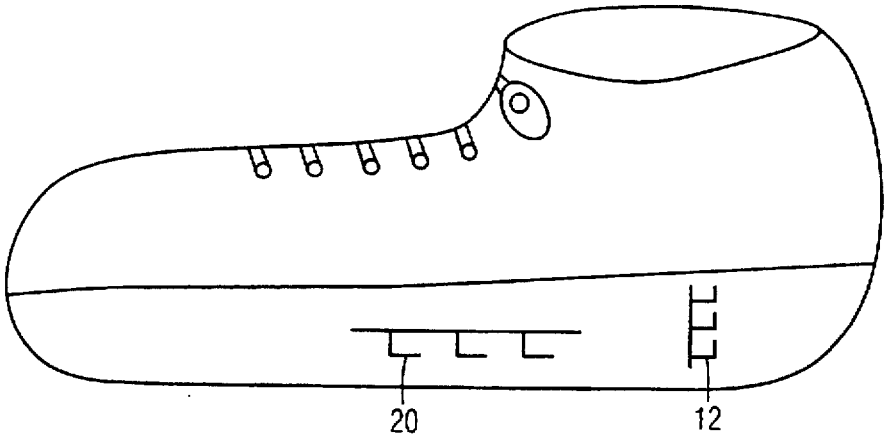
FIG. 10 is a side elevational view of a shoe with slots for the crossbar embodiments for both tension and heel plate level adjustments.
Figure 11:
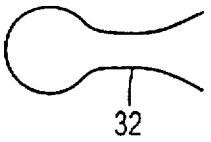
FIG. 11 is an enlarged view of a crossbar receptor.
Figure 12:
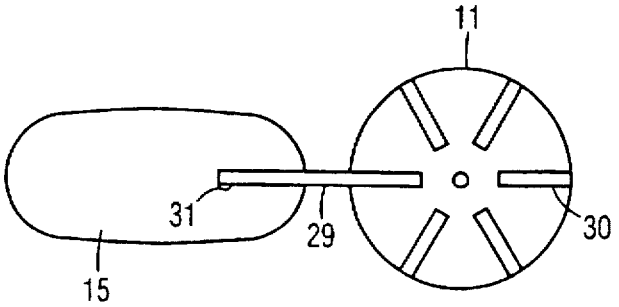
FIG. 12 is an enlarged side elevational view of a dial with receptor slots for a latch to lock in the dial's position, for tension and/or heel plate adjustment.

Another embodiment, as seen in FIG. 9 in order to achieve an adjustable heel plate (2) angle would be to utilize a strong, flexible, thin cable, rope or string (35) as a means for adjusting the angle that is attached to the underside of the heel plate (2). The other end, hanging downward, should be attached to a crossbar (34) located below the heel plate (2). The string (35), when completely unrestricted, allows for the heel plate (2) to be at its maximum upright position. By forcing the string (35) downward by take-up means, either by pulling the crossbar (34) downward or by turning the crossbar (34) so that the string (35) wraps around it, heel plate (2) is adjusted to a new, lower, maximum height. Referring to FIG. 10, in order to keep the crossbar (34) down, a series of vertical slots (12) can be employed so that the position of crossbar (34) can be locked in. Such slots (12) extend and are located on both sides of the shoe. Small crossbar receptors (32) as seen in FIG. 11 can be utilized in order to prevent the crossbar (34) from slipping out unintentionally. In order to adjust the heel plate (2) angle, the crossbar (34) is manipulated from the outside of the shoe, by means of small handles or knobs similar to knobs (49*a*) and (49*b*) shown in FIG. 1. The crossbar (34) alternative works best with the string attached close to the front (closer to the flap area) of the heel plate (2). An external (that is, located on the exterior of the shoe) dial (11), as-seen in FIG. 12, (or a pair of dials—one located on each side of the shoe) could be used as an alternative to the crossbar (34) if the string (35) is located towards the rear of the shoe. In order to lock a position, a dial-latch (29) can be employed as illustrated in FIG. 12. This latch (29) pivots on a pin (31) and said latch (29) is inserted into receptor slots (30) located on the dial (11). The latch (29) resides in a concave area (15) so that the person's fingers will be able to make the desired changes. It is desirable in both instances (with a crossbar (34) or dial (11) alternative) to have the string (35) interfere as little as possible and be as transparent as possible with the downward deflection of the heel plate (2).

Figure 13:
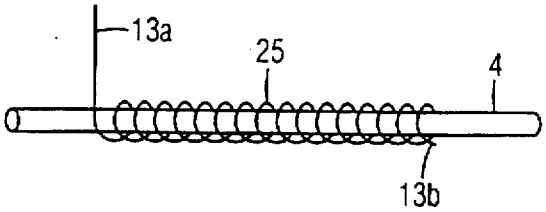
FIG. 13 is an enlarged view of the horizontal rod with surrounding helical coil.

Referring to FIG. 13, surrounding the horizontal rod (4) that is used to combine the heel plate (2) with the bracket (1), is a biasing means in the form of a helical spring (25) that has two tails (13*a*) and (13*b*) which come over the top of the rod (4)—one pointing towards the front of the shoe, tail (13*b*), and the other pointing towards the back of the shoe, tail (13*a*). In the preferred embodiment, the tail end (13*a*) facing the back of the shoe is long and straight and is fed underneath the heel plate (2). It may be desirable, however, to make such rear facing tail end (13*a*) rounded in the shape of the heel plate (2) at the risk of being more complex and costly to construct. The tail end (13*b*) of the spring (25) facing the front of the shoe may be attached either to the horizontal rod (4), to a disk (14) located on the rod (4) (between all four flaps (27*a*), (27*b*), (26*a*) and (26*b*) ) that is either capable of turning independently or is attached to the horizontal rod (4). It is also possible to have the forward facing spring tail end (13*b*) suspended on its own. In each of these situations it is essential that the tail end (13*b*) facing the front of the shoe be restricted so that it does not rise beyond a certain level since this provides the heel plate (2) with upward force that is derived, in part, from the tension placed on the helical spring (25) by the spring tail (13*b*) pointing towards the front of the shoe. By manipulating this front facing spring tail (13*b*) so that it is forced further downward (essentially "tightening" or winding the spring (25)) provides an adjusting means for an overall increase in the tension of the spring (25) and hence requires more force on the heel plate (2) in order to cause it to pivot downward.

Figure 14:
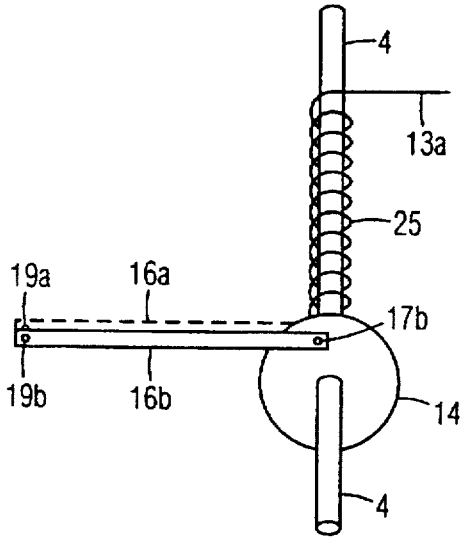
FIG. 14 is a perspective view of the horizontal rod with a disk located on it.

The preferred embodiment for an adjusting means for increasing the tension of the device utilizes a means for winding and unwinding the coils of spring (25) comprising a disk (14) located on the rod (4) which is allowed to rotate independently of the rod (4). The disk (14) has attached to it the forward facing spring tail (13*b*). Preferably, the disk (14) should have riveted on its top portion metal bars (16*a*) and (16*b*), as illustrated in FIG. 14. One bar could be used, however this would result in a less stable device. These metal bars (16*a*) and (16*b*) are given ample freedom to rotate around pivots (17*a*) and (17*b*) located on the disk (14). Metal bars (16*a*) and (16*b*) and pivot (17*a*) and (17*b*) should be loose enough in order to not restrict motion of the metal bars (16*a*) and (16*b*) around pivots (17*a*) and (17*b*). In this way, by pulling metal bars (16*a*) and (16*b*) towards the front of the shoe, the disk (14) is rotated towards the front of the shoe, thereby increasing tension on the spring (25). The metal bars (16*a*) and (16*b*) can be brought forward by means of a crossbar (18), as seen in FIG. 2. The crossbar (18) extends to the outer portion of the shoe. Such crossbar (18) fits through holes (19*a*) and (19*b*) located on the end of metal bars (16*a*) and (16*b*). This crossbar (18) can latch by means of a crossbar receptor (32) of FIG. 11, and the force generated from the spring (25) which forces the crossbar (18) towards the back of the shoe into different positioning means or horizontal slots (20) or slightly positive angled slots towards the back of the shoe located alongside the lower outside portion of the shoe, as illustrated in FIG. 10. An alternative to the utilization of metal bars (16*a*) and (16*b*) would be a metal cable (not shown) substituted for said metal bars (16*a*) and (16*b*). In this way it is possible to have more rotation of the disk (14) than in the prior embodiment since the current arrangement allows for the cable to be riveted further back on the disk (14) than would be the case in the metal bars (16*a*) and (16*b*) embodiment.

The crossbars that extend to the outside of the shoe, both for adjusting the angle of the heel plate (2) and for adjusting the tension of the device—the former crossbar being identified as (34) and the latter crossbar as (18), should be made as thin as possible, without compromising strength and durability, in order to minimize water intake to the shoe. External knobs (49*a*) and (49*b*) on crossbar (18) and (34) pass through the outersole wall, in order to facilitate manipulation of the position of crossbars (18) and (34). Rubber guards (not shown) would also prove beneficial, as would multiple walls, in keeping water and other substances out of the shoe's interior.

Figure 15:
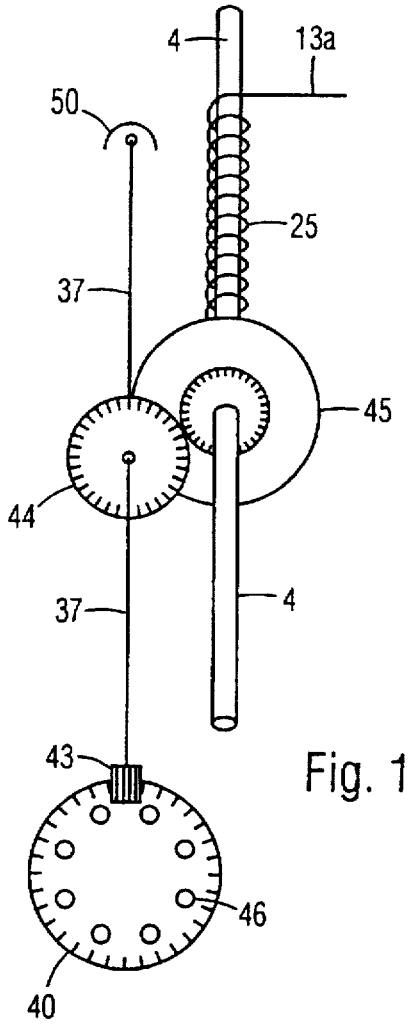
FIG. 15 is a perspective view of a gear arrangement for adjusting the tension of the device.
Figure 16:
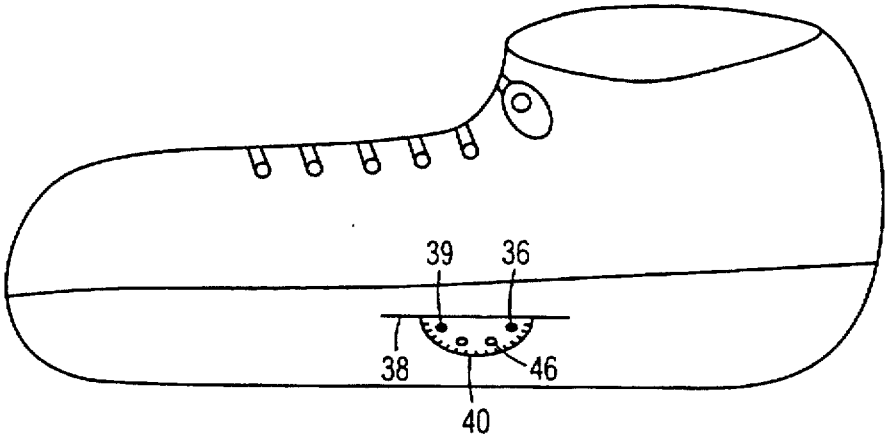
FIG. 16 is a side elevational view of a shoe showing a horizontal dial used in the gear embodiment for adjusting tension.

As illustrated in FIG. 15 another embodiment of a means for winding and unwinding the coils of spring (25) in order to achieve an adjustment in the tension has the spring tail (13*b*) facing the front of the shoe permanently affixed to a gear disk (45) that is located on the rod (4), and is preferably independently rotatable with respect to the rod (4) (however, this need not be the case in order to work). By turning the disk (45) towards the front of the shoe it will increase the tension of the device. As seen in FIG. 15, a secondary rod (37) and a series of gears (40), (43), and (44) work to turn disk (45) from the exterior of the shoe. An exterior horizontal dial gear (40) meshes with vertical gear (43) which turns shaft (37). The shaft (37) has attached on its other end vertical gear (44) which meshes with gear disk (45), which has gears on it. It is important that gears (43) and (44) and shaft (37) not interfere with the bracket (1) and other components. Shaft (37) fits through pillar (50) where shaft (37) ends. By designating vertical gear (43) as the "dial" that extends to the outside of the shoe, it will translate into a vertical dial for the device in order to adjust its tension. This design may be preferential depending on the tolerance of the spring (25) employed. The embodiments described in this paragraph permits for unlimited rotation of the forward facing spring tail (13*b*) whereas the preferred embodiment allows for not more than one rotation of the forward facing spring tail (13*b*) and rod (4). In order to make the upward dial (43) arrangement work, a dial and latch arrangement that works identical to the one described in connection with FIG. 12, as described previously relating to adjusting the angle of the heel plate (2) under the string embodiment, would be most suitable in order to adjust tension with vertical dial (43). In order to lock the dial (43) in the desired tension, a latch (not shown) would be employed. This dial (43) and latch can be accessed from the shoe's exterior. The latch would stabilize the dial (43) in the corresponding position for a desired tension level. The dial (43) would have slots (not shown) to accept such latch. In order to adjust the tension, one would pivot out the latch, turn the dial (43) to the new desired position and then reinsert the latch into the corresponding slot located on the dial (43). If choosing to use the horizontal dial (40) alternative, as seen in FIG. 16, then in order to lock in the dial's (40) position two pins (36) and (39) would be inserted downward into two in a series of pin holes (46) located on this dial (40). The pins (36) and (39) are inserted into the two pin holes (46) located next to the narrow dial receptor slot (38).

Figure 17:
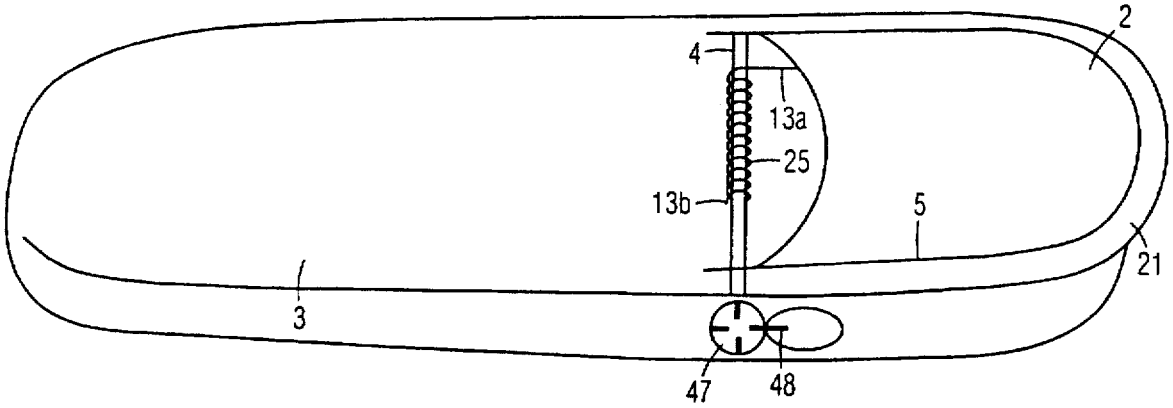
FIG. 17 shows an alternative embodiment for adjusting the tension of the device.

As an alternative to the tension adjusting embodiment described in the preceding paragraph, another embodiment, as illustrated in FIG. 17 could be utilized. In this embodiment of a means for winding and unwinding the coils of spring (25), horizontal rod (4) is extended to the exterior of the shoe and a vertical dial (47) with latches (48) functions to lock in desired tension levels. Dial (47) and latch (48) work identical to the dial and latch described in FIG. 12. This adjustable tension feature may be desirable in order to accommodate individuals who partake in various activities each with different requirements, and individuals who are likely to run on different surfaces, each having unique impact consequences. Another important issue relating to adjustable tension is the ability of the device to accommodate people of different weights.

As a person walks, or runs, their heel strikes the heel plate (2) which is normally (when no weight is placed on it) forced by the spring (25) to remain in the most upward incline position permitted. However, the heel strike is too much for the spring (25) to overcome, leading to a downward pivot of the heel plate (2) on the horizontal rod (4). The heel plate (2) should leave some room around the back perimeter of the shoe in order to accommodate a rear collar (21) that is U-shaped, as illustrated in FIG. 1. Such rear collar (21) is situated around the rounded back portion of the shoe. This collar (21) resides below the level of the heel plate (2) in its stable state, that is, when no downward force is placed on it. Collar (21) helps to push up the outer edges of the insole once the heel forces the heel plate (2) downward. In this way, the outer edges by the insole act to cradle the heel upon impact. As the person lifts their foot a portion of the shock energy captured by spring (25) during heel strike is returned to the foot as the heel lifts. At that time the heel plate (2) will pivot upward and be repositioned to absorb the shock associated with the next step.

The foregoing means for changing of the heel plate's (2) angle when dormant can be achieved in many ways. for instance, a monkey wrench type device (not shown) could be employed. By turning the horizontal dial on the device indicates the height of an upper arm which serves as the maximum height of which the heel plate (2) cannot rise above. One other way of adjusting the heel plate's (2) angle (not shown) would utilize a small rotatable arm that establishes an upper boundary for the heel plate (2). Such rotatable arm is located on the inside of the shoe and can be adjusted by means of a lever located on the outside of the shoe. The device locks into place by tightening, on the outside of the shoe, a nut-like adjustment device which fits onto a screw-like structure which extends from the shoe's interior where it is attached to the rotatable arm.

Figure 18:
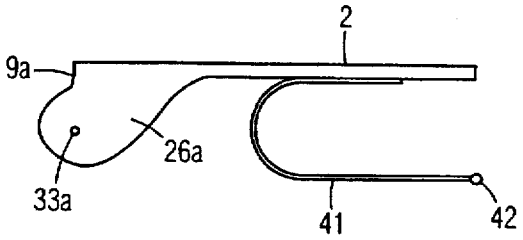
FIG. 18 is an embodiment that substitutes the helical spring for a resilient spring strip situated below the heel plate.
Figure 19:
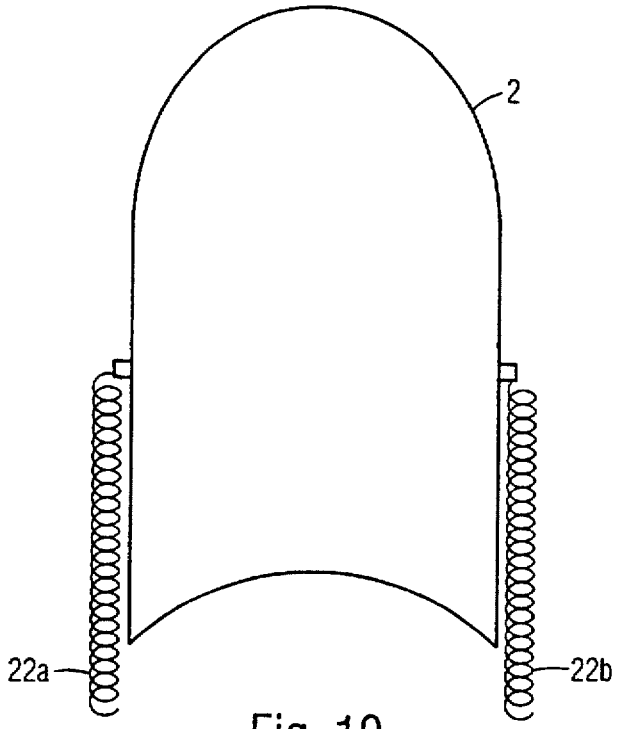
FIG. 19 is an alternative embodiment showing two springs in use in the present invention.

There are many alternatives to the use of a helical spring (25) as the biasing means to provide upward tension on the heel plate (2). One method, as seen in FIG. 18, utilizes as the biasing means a resilient leaf spring or spring strip (41) (or bed of springs—not shown) underneath the heel plate (2). The movement of said resilient spring strip (41) upward by means of a crossbar (42) that can lift the lower part of the resilient spring strip (41) upward and lock in the position (by means of slots, similar to the ones mentioned previously), or the like, provides an adjusting means for additional tension by providing means for raising and lowering the lower part of resilient spring strip (41). Even though a resilient spring strip is utilized, this design will not have the same shortcomings associated with typical resilient spring strip devices, as the present invention utilizes a heel plate (2) that pivots on a rod (4) and therefore has an even angle throughout. Alternatively, as illustrated in FIG. 19, springs (22*a*) and (22*b*) can be attached to both ends of the heel plate (2), and extend towards the front of the shoe horizontally. In order to adjust tension, springs (22*a*) and (22*b*) can be attached to different pegs (not shown) located alongside the base of the shoe, or via (not shown) a horizontally moving crossbar that fits into slots to provide adjusting means. Adjustment can be made from the shoe exterior. Forward movement (towards the front of the shoe) of the moveable end of the springs (22*a*) and (22*b*) allows for an overall increase in the tension level of the device. One other method (not shown) would employ springs attached vertically to the top of the heel plate (2). The spring end not attached to the heel plate (2) attaches to pegs that extend upward. Such adjustment is achieved through the exterior of the shoe.

Figure 20:
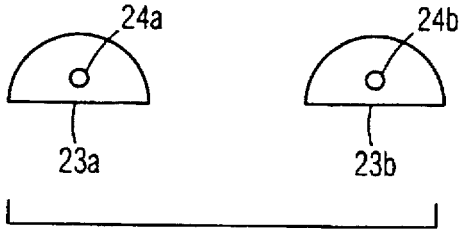
FIG. 20 illustrates an alternative to the bracket described in the preferred embodiment.

The bracket described could have many designs. Referring to FIG. 20, it could even be simply a pair of pillars (23*a*) and (23*b*) attached to the bottom of the midsole with holes (24*a*) and (24*b*) to accept the rod (4). Such a design works best with a resilient spring strip used to create upward force on the heel plate (2). However, it could also work with the helical spring (25) that surrounds the rod (4). The angle of the heel plate (2) can be altered, for instance, with a latch (that works similar to (10*a*) and (10*b*) ) that collides with the heel plate's cutout portion (9*a*) and (9*b*).

The bracket (1), heel plate (2), crossbars, rods, etc. need not be made of metal as they can easily be substituted with strong plastic and other materials. Also, the heel plate's cutout portion (9*a*) and (9*b*) need not be perfectly vertical, it may be curved at some point in order to cease the plate's (2) motion at a particular angle.

The foregoing detailed description has been given for clearness and understanding purposes. Therefore, no limitations should be understood therefrom. Various changes and modifications may be made therein without department from the spirit and scope of the invention.

What is claimed is:

1. An adjustable shock absorbing device for a shoe, comprising:

(a) a substantially horizontal stiff bracket fixedly secured to a midsole of said shoe;

(b) a thin, inflexible heel plate disposed in a heel portion of said shoe generally below the calcaneous of the wearer's heel;

(c) mounting means for pivotally mounting said heel plate at a forward end thereof to said fixed bracket so that side ways movement of said heel plate relative to said fixed bracket is prevented;

(d) biasing means for biasing the rearward end of said heel plate vertically relative to said fixed bracket so that upon deflection of said heel plate by a heel strike by the wearer of the shoe, the energy thereof is at least partially absorbed by said biasing means and returned to the wearer's heel subsequent to said heel strike;

(e) adjusting means for said biasing means to increase or decrease the tension of said biasing means; and (f) at least one stop arranged on said heel plate at the forward end thereof and a complimentary latch pivotally mounted to said horizontal bracket for horizontal movement for engagement with said stop whereby said heel plate is thereby disposed horizontally relative to said horizontal bracket.

2. The adjustable shock absorbing device for a shoe as defined in claim 1, which further includes means for adjusting the pivot angle of said heel plate relative to said horizontal bracket so as to adjust said heel plate between a substantially horizontal position to a predetermined maximum pivot angle relative to said horizontal bracket.

3. The adjustable shock absorbing device for a shoe as defined in claim 2, wherein said means for adjusting the pivot angle of said heel plate relative to said horizontal bracket comprises a flexible cord attached to the rearward end of said heel plate extending downwardly to a take-up means for taking up said cord to lower or raise the rearward end of said heel plate.

4. The adjustable shock absorbing device for a shoe as defined in claim 1, wherein said mounting means comprises a pair of vertical flaps laterally arranged on said fixed bracket, and a pair of vertical flaps laterally arranged at the forward end of said heel plate, said heel plate flaps being disposed laterally adjacent said fixed bracket flaps and pivotally mounted thereto.

5. The adjustable shock absorbing device for a shoe as defined in claim 4, wherein said heel plate flaps and said fixed bracket flaps are provided with aligned openings in which is mounted a horizontal pivot rod whereby said heel plate is pivotally mounted to said fixed bracket.

6. The adjustable shock absorbing device for a shoe as defined in claim 5, wherein said heel plate flaps and said fixed bracket flaps are vertically arranged downwardly from said heel plate and said fixed bracket, respectively, so that said horizontal pivot rod is arranged below said fixed bracket and said heel plate.

7. The adjustable shock absorbing device for a shoe as defined in claim 6, wherein said biasing means comprises a helical spring arranged around said pivot rod having a first tail end extending beneath said heel plate and engaging the same to provide a biasing force thereto.

8. The adjustable shock absorbing device for a shoe as defined in claim 7, wherein the adjusting means for said biasing means includes means for winding and unwinding the coils of said helical spring to increase and decrease the tension thereof.

9. The adjustable shock absorbing device for a shoe as defined in claim 8, wherein the means for winding and unwinding the helical spring coils includes a disc axially mounted onto said pivot rod to which is fixedly secured a second tail end of said helical spring, a connecting rod extending horizontally from the periphery of said disc, a laterally extending rod engaging the end of said connecting rod opposite the connection to the disc periphery, said rod extending laterally from said shoe for physical engagement by the wearer, and positioning means on said shoe to position said laterally extending rod forwardly and rearwardly so as to more or less tightly wind said helical coil.

10. The adjustable shock absorbing device for a shoe as defined in claim 8, wherein the means for winding and unwinding the helical spring coils includes a disc axially mounted onto said pivot rod to which is secured a second tail end of said helical spring, said disc having engagement slots arranged circumferentially thereon, and a latch arranged on said shoe for engagement with said slots to fix the position of said disc, whereby when said latch is disengaged from said disc, said disc can be rotated to wind and unwind the coils of said helical spring to adjust the tension thereof.

11. The adjustable shock absorbing device for a shoe as defined in claim 8, wherein the means for winding and unwinding the helical spring coils includes a first disc gear axially mounted onto said pivot rod to which is secured a second tail end of said helical spring, a second disc gear engaged with said first disc gear and driven by a rack and pinion gear, set the rack gear of which extends laterally from the shoe for moveable engagement by the wearer.

12. The adjustable shock absorbing device for a shoe as defined in claim 1, wherein said biasing means comprises a leaf spring having a first end fixed to said shoe and a second end engaging said heel plate.

13. The adjustable shock absorbing device for a shoe as defined in claim 12, wherein said adjusting means for said biasing means comprises means for raising and lowering the first end of said leaf spring relative to said second end.

14. The adjustable shock absorbing device for a shoe as defined in claim 1, wherein said biasing means comprises at least one helical spring engaging a lateral side of said heel plate and extending forwardly therefrom to a fixed position on said shoe.

* * * * *